US009186537B2

(12) United States Patent
Arnold et al.

(10) Patent No.: US 9,186,537 B2
(45) Date of Patent: Nov. 17, 2015

(54) INCREMENTAL WEIGHT AND SELECTOR

(71) Applicant: Precor Incorporated, Woodinville, WA (US)

(72) Inventors: Peter J. Arnold, Snohomish, WA (US); Jonathan M. Stewart, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 97 days.

(21) Appl. No.: 13/733,440

(22) Filed: Jan. 3, 2013

(65) Prior Publication Data

US 2014/0187390 A1 Jul. 3, 2014

(51) Int. Cl.

| | |
|---|---|
| ***A63B 21/08*** | (2006.01) |
| ***A63B 21/062*** | (2006.01) |
| *A63B 21/06* | (2006.01) |

(52) U.S. Cl.

CPC ..... *A63B 21/062* (2013.01); *A63B 21/0602* (2013.01); *A63B 21/0603* (2013.01); *A63B 2021/0623* (2013.01)

(58) Field of Classification Search

USPC ..... 482/98, 92–94

See application file for complete search history.

(56) References Cited

U.S. PATENT DOCUMENTS

| | | | | |
|---|---|---|---|---|
| 323,792 | A | 8/1885 | Coop et al. | 482/102 |
| 772,906 | A | 10/1904 | Reach | |
| 848,272 | A | 3/1907 | Thornley | |
| 3,627,315 | A | 12/1971 | Marcyan | 272/81 |
| RE28,066 | E | 7/1974 | Marcyan | 482/106 |
| 4,538,805 | A | 9/1985 | Parviainen | 482/98 |
| 4,546,970 | A | 10/1985 | Mahnke | 272/118 |
| 4,627,615 | A | 12/1986 | Nurkowski | 272/118 |
| 4,712,793 | A | 12/1987 | Harwick et al. | 482/99 |
| 4,817,943 | A | 4/1989 | Pipasik | 272/117 |
| 4,834,365 | A | 5/1989 | Jones | 482/100 |
| 4,971,305 | A | 11/1990 | Rennex | 482/93 |
| 5,123,885 | A | 6/1992 | Shields | 482/106 |
| 5,135,453 | A | 8/1992 | Sollenberger | 482/101 |
| 5,306,221 | A | 4/1994 | Itaru | 482/98 |
| 5,429,569 | A | 7/1995 | Gunnari et al. | 482/100 |
| 5,643,152 | A | 7/1997 | Simonson | 482/100 |
| 5,655,997 | A | 8/1997 | Greenberg et al. | 482/5 |
| 5,669,861 | A | 9/1997 | Toups | 482/98 |
| 5,776,040 | A | 7/1998 | Webb et al. | 482/98 |
| 5,785,632 | A | 7/1998 | Greenberg et al. | 482/5 |
| 5,839,997 | A | 11/1998 | Roth et al. | 482/107 |
| 5,876,313 | A | 3/1999 | Krull | 482/98 |

(Continued)

FOREIGN PATENT DOCUMENTS

| | | |
|---|---|---|
| DE | 20 2004 006 399 | 7/2004 |
| EP | 1614450 A1 | 11/2006 |
| SU | 1644983 | 4/1991 |

*Primary Examiner* — Loan H Thanh

*Assistant Examiner* — Megan Anderson

(74) *Attorney, Agent, or Firm* — Terrence P. O'Brien; Todd A. Rathe

(57) ABSTRACT

An exercise apparatus comprises an incremental weight system. The incremental weight system comprises an incremental weight and an incremental weight selector. The incremental weight selector is liftable by a weight lift and has a lever movable between a lowered position and a raised position to actuate the selector between an engaged position engaging the incremental weight such that the incremental weight is liftable with a first weight by the weight lift and a disengaged position disengaged from the incremental weight such that the first weight is liftable independent of the incremental weight.

19 Claims, 10 Drawing Sheets

(56) References Cited

U.S. PATENT DOCUMENTS

| | | | | |
|---|---|---|---|---|
| 5,935,048 | A | 8/1999 | Krull | 482/98 |
| 5,944,642 | A | 8/1999 | Krull | 482/98 |
| 6,015,367 | A | 1/2000 | Scaramucci | 482/5 |
| 6,033,350 | A | 3/2000 | Krull | 482/98 |
| 6,117,049 | A | 9/2000 | Lowe | 482/4 |
| 6,126,579 | A | 10/2000 | Lin | 482/98 |
| 6,174,265 | B1 | 1/2001 | Alessandri | 482/5 |
| 6,183,401 | B1 | 2/2001 | Krull | 482/98 |
| 6,186,927 | B1 | 2/2001 | Krull | 482/98 |
| 6,224,519 | B1 | 5/2001 | Doolittle | 482/98 |
| 6,322,481 | B1 | 11/2001 | Krull | 482/107 |
| 6,387,018 | B1 | 5/2002 | Krull | 482/98 |
| 6,387,019 | B1 | 5/2002 | Krull | 482/98 |
| 6,387,021 | B1 | 5/2002 | Miller, Jr. | 482/99 |
| 6,402,666 | B2 | 6/2002 | Krull | 482/107 |
| 6,422,979 | B1 | 7/2002 | Krull | 482/98 |
| 6,436,013 | B1 | 8/2002 | Krull | 482/94 |
| 6,447,432 | B1 | 9/2002 | Krull | 482/98 |
| 6,468,189 | B2 | 10/2002 | Alessandri | 482/99 |
| 6,497,639 | B2 | 12/2002 | Webber et al. | 482/98 |
| 6,540,650 | B1 | 4/2003 | Krull | 482/107 |
| 6,629,910 | B1 | 10/2003 | Krull | 482/98 |
| 6,632,161 | B1 | 10/2003 | Nir | 482/98 |
| 6,666,800 | B2 | 12/2003 | Krull | 482/94 |
| 6,669,606 | B2 | 12/2003 | Krull | 482/98 |
| 6,679,816 | B1 | 1/2004 | Krull | 482/107 |
| 6,719,672 | B1 | 4/2004 | Ellis et al. | 482/99 |
| 6,719,674 | B2 | 4/2004 | Krull | 482/106 |
| 6,733,424 | B2 | 5/2004 | Krull | 482/98 |
| 6,746,381 | B2 | 6/2004 | Krull | 482/108 |
| 6,749,547 | B2 | 6/2004 | Krull | 482/106 |
| 6,855,097 | B2 | 2/2005 | Krull | 482/107 |
| 6,896,645 | B1 | 5/2005 | Krull | 482/107 |
| 6,899,661 | B1 | 5/2005 | Krull | 482/107 |
| 6,902,516 | B2 | 6/2005 | Krull | 482/98 |
| 6,974,405 | B2 | 12/2005 | Krull | 482/107 |
| 6,997,856 | B1 | 2/2006 | Krull | 482/104 |
| 7,011,609 | B1 | 3/2006 | Kuo | 482/94 |
| 7,048,677 | B2 | 5/2006 | Mackert et al. | 482/102 |
| 7,060,011 | B1 | 6/2006 | Krull | 482/107 |
| 7,066,867 | B2 | 6/2006 | Krull | 482/108 |
| 7,077,790 | B1 | 7/2006 | Krull | 482/106 |
| 7,077,791 | B2 | 7/2006 | Krull | 482/108 |
| 7,090,623 | B2 | 8/2006 | Stewart et al. | 482/100 |
| 7,128,696 | B1 | 10/2006 | Krull | 482/107 |
| 7,128,697 | B1 | 10/2006 | Krull | 482/108 |
| 7,153,243 | B1 | 12/2006 | Krull | 482/107 |
| 7,179,208 | B1 | 2/2007 | Nalley | 482/99 |
| 7,252,627 | B2 * | 8/2007 | Carter | 482/98 |
| 7,413,532 | B1 * | 8/2008 | Monsrud et al. | 482/99 |
| 8,137,248 | B1 | 3/2012 | Krull | 482/98 |
| 2002/0049123 | A1 | 4/2002 | Krull | 482/98 |
| 2002/0151413 | A1 | 10/2002 | Dalebout et al. | 482/54 |
| 2003/0040407 | A1 | 2/2003 | Rothacker | 482/106 |
| 2003/0092542 | A1 * | 5/2003 | Bartholomew et al. | 482/99 |
| 2005/0176559 | A1 | 8/2005 | Carter | 482/94 |
| 2006/0217245 | A1 | 9/2006 | Golesh et al. | 482/94 |
| 2007/0149366 | A1 | 6/2007 | Kuo | 482/98 |
| 2012/0010055 | A1 * | 1/2012 | Webb et al. | 482/98 |

* cited by examiner

INCREMENTAL WEIGHT AND SELECTOR

BACKGROUND

Stacks of weights are sometimes employed in exercise devices and in other testing or calibration equipment to permit different total weight amounts to be selected for being lifted, dropped or applied. Many devices include a fixed number of weight plates having predefined weight increments. Some devices allow a person to add a smaller increment of weight. Unfortunately, in present devices, the addition of the smaller incremental weight is often tedious and may be relatively complex, requiring costly mechanisms.

DETAILED DESCRIPTION OF THE EXAMPLE EMBODIMENTS

Figure 1:
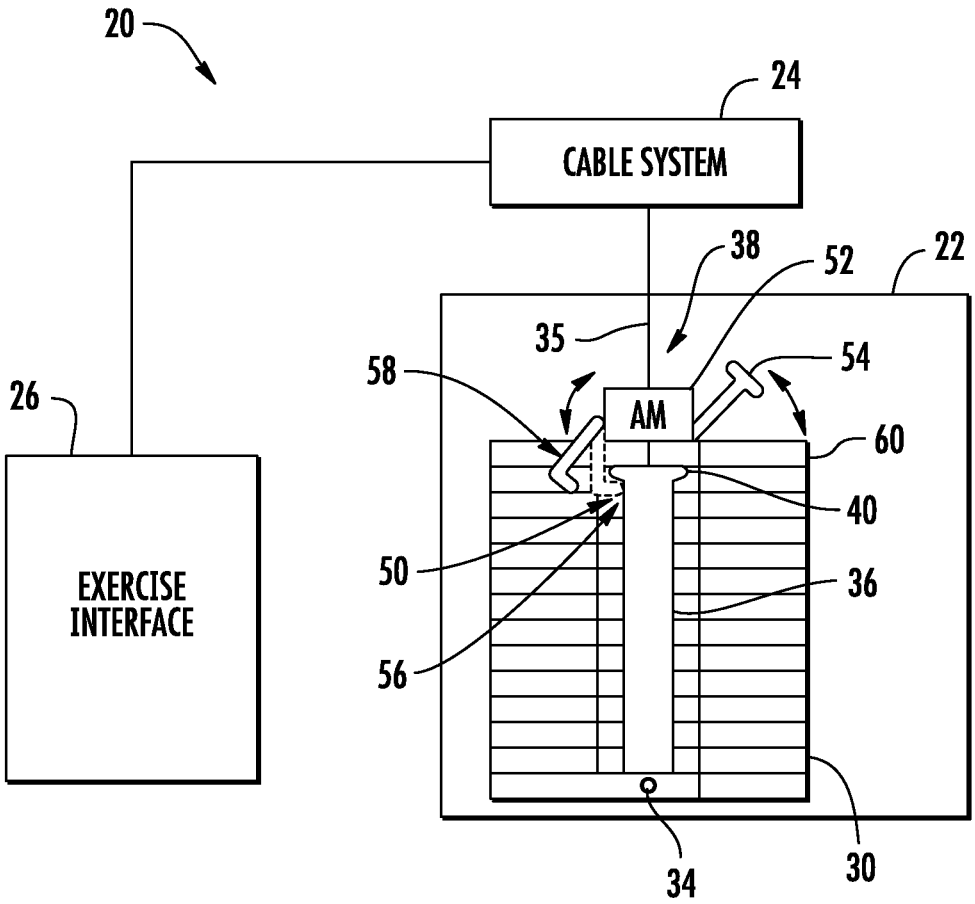
FIG. 1 is a schematic illustration of an example exercise device.

FIG. 1 schematically illustrates exercise device 20 according to one example embodiment. Exercise device 20 includes weight system 22, cable system 24 and exercise interface 26. Weight system 22 comprises a system by which a person may select a total amount of weight to be utilized and ultimately lifted in an exercise. Weight system 22 generally includes main weights 30, main weight selection system 34, weight lift 35, incremental weight 36 and incremental weight selection system 38.

Weights 30 comprise structures having predetermined weight amounts which are configured to be lifted and to provide a mechanical resistance in an exercise. In the particular example illustrated, weights 30 each comprise a solid or hollow plate of one or more metals. In other embodiments, weights 30 may comprise other materials or may comprise encapsulated materials, such as sand, water or other materials. Weights 30 are stacked upon one another such that as a particular weight 30 is being lifted, other weights 30 stacked upon the particular weight 30 are also lifted.

Main weight selection system 34 comprises a mechanism configured to permit a person to select one or more of weights 30 for lifting during an exercise. In one implementation, main weight selection system 34 comprises an elongate rod connected to weight lift 35, extending through weights 30 and having apertures corresponding to apertures in each of weights 30, wherein a person selects a lowermost weight of the stack to be lifted by inserting a pin through the elongate rod and through the aligned aperture of the selected weight 30. In other implementations, main weight selection system 34 may comprise other mechanisms for selecting the lowermost weight of the stack of weights to be coupled to main weight lift system 35 for lifting.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Weight lift 35 comprises a structure coupled to main weight selection system 34 which is connected to cable system 24. In one implementation, weight lift 35 may itself comprise a cable connected to the above-described rod of main weight selection system 34.

Incremental weight 36 comprises a member having a predetermined weight amount that is configured to be selectively connected to weight lift 35 by incremental weight selection system 38. In one embodiment, incremental weight 36 has a weight amount less than a predetermined weight amount of each of main weights 30. For example, in one embodiment, each of main weights 30 may be 10 pounds while incremental weight 36 is 5 pounds. In one embodiment, incremental weight 36 may comprise 2.5 pound incremental weight. Incremental weight 36 permits a person to select a total amount of weight for an exercise that is intermediate or between the larger weight increments provided by main weights 30.

As schematically represented in FIG. 1, incremental weight 36 longitudinally extends across multiple weights 30. In the example implementation, incremental weight 36 extends along a rear face of main weights 30, being at least partially received within aligned notches or cut outs of main weights 30. In some implementations, such notches may be omitted. Incremental weight 36 includes a hook recipient 40 to be hooked by incremental weight selection system 38. In the example illustrated, hook recipient 40 comprises a lip, overhang or catch. In other implementations, hook recipient 40 may comprise a detent, notch or aperture for receiving a hook or catch.

Incremental weight selection system 38 comprises a mechanism configured to selectively add or remove incremental weight 36 from the total amount of weight connected to weight lift 35. Incremental weight selection system 38 comprises hook 50, actuation mechanism 52 and actuation lever 54. Hook 50 comprises a member movable between an incremental weight engaged position 56 and a disengaged position 58. In one implementation, hook pivots about a horizontal axis between positions 56, 58. In the engaged position 56, hook 50 catches upon hook receiver 40 such that incremental weight 36 is additionally lifted with whatever main weights 30 are being lifted. In the disengaged position 58, hook 50 is released from hook receiver 40 such that whatever main weights 30 are being lifted are lifted independent of and without the lifting of incremental weight 36.

Actuation mechanism 52 comprises a mechanism carried by and resting upon an uppermost plate 60. Actuation mechanism 52 is operably coupled between actuation lever 54 and hook 50. Actuation mechanism 52 transmits force from actuation lever 54 to hook 50 to move hook 50 between positions 56, 58. In one implementation, actuation mechanism 52 utilizes and transmits force from actuation lever 54 to move hook 50 from the engaged position 56 to the disengaged position 58 against the force of a spring or bias that resiliently biases hook 50 towards the engaged position 56. Because hook 50 is resiliently sprung into an engaged position, incremental weight selection system 38 provides an integrated automatic reset to a usable position even if incremental weight 36 is selected when top plate 60 is not in the home position, but is being lifted.

In one implementation, actuation mechanism 52 is configured such that downward movement of manual lever 54 allows the spring to resiliently bias hook 50 into the engaged position 56. As a result, vertical movement of lever 54 in a downward direction increases the weight of the stack of weights being lifted, similar to downward vertical positioning of the pin of main weight selection system 34, wherein "down" means more weight. As a result, incremental weight selection system 38 is intuitive in its use.

Actuation lever 54 extends forward of the stack of weights 30. Actuation lever 54 is configured to be pivoted such that force is transmitted by actuation mechanism 52 to hook 50. As noted above, in one implementation, actuation lever 50 force configured such that downward movement of lever 54 allow the first spring to resiliently biased hook 50 into the engaged position, while raising or lifting of lever 54 moves hook 50 against the bias of the spring to the disengaged position 58. In one implementation, actuation lever 54 comprises an over center toggle mechanism such that lever 50 is retained in a lowered position (the position in which hook 50 is biased by a first spring to the engaged position 56) by over-center action of a second spring.

Cable system 24 comprises a system of pulleys and cables configured to operably couple weight lift 35 (and any connected weights 30, 36) to exercise interface 26. Cable system 24 may have any of a variety of different sizes, shapes and configurations depending upon exercise interface 26. In other embodiments, exercise interface 26 may be operably coupled to weight system 22 by other mechanisms.

Exercise interface 26 comprises a device or mechanism operably coupled to cable system 24 by which one or more persons may exert force against one or more structures and may move the one or more structures to raise or lift a selected amount of weight provided by weights 30 and/or 36. Exercise interface 26 may have various configurations depending upon which particular muscles or groups of muscles are to be exercised. Examples of exercise interface 26 include, but are not limited to the following types of exercise machines: abdominal isolator, angled seated calf, abductor, seated leg curl, glute isolator, vertical and horizontal, rear delt/pec fly, lateral raise, shoulder press, vertical press, back extension, seated row, vertical row, pulldown, long pull, seated dip, seated tricep extension, bicep curl, camber curl and bench press. Exercise interface 26 may be provided as part of a multi-station exercise machine, a modular exercise machine or a single station exercise machine.

Figure 2:
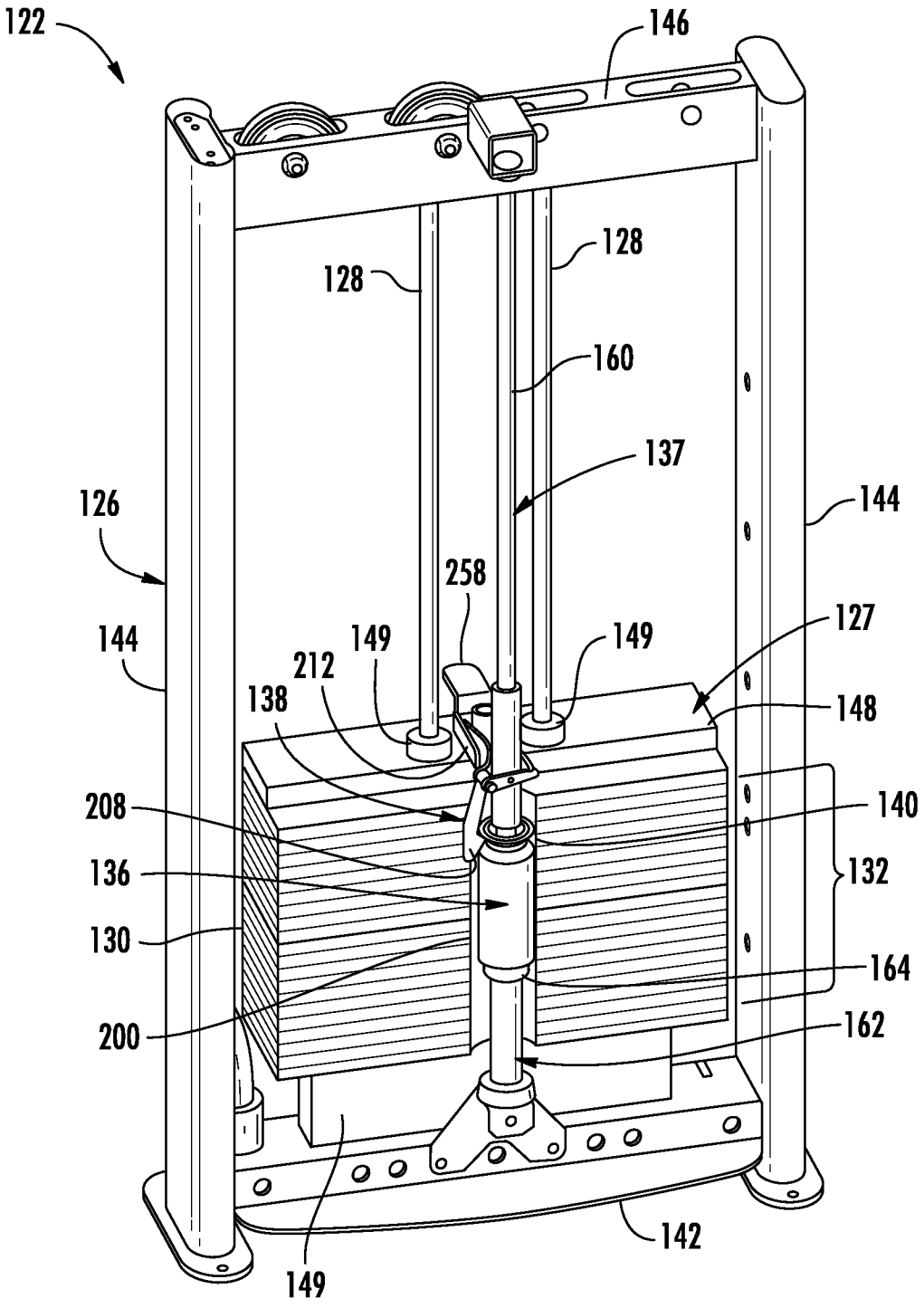
FIG. 2 is a rear perspective view of an example implementation of a weight system of the exercise device of FIG. 1.

FIG. 2 illustrates weight system 122, an example implementation of weight system 22 which may be employed as part of exercise device 20 shown in FIG. 1. Weight system 122 comprises frame 126, upper guides 127, guide rods 128, weights 130 forming a main weight stack 132, main weight selection system 34 (described above), weight lift 35 (described above), incremental weight 136, incremental weight guide and support 137 and incremental weight selection system 138. Frame 126 comprises an arrangement of components configured to serve as a foundation and support for weight system 122. Frame 126 includes base 142, side beams 144, and the top support 146.

Upper guide 127 comprises an arrangement of structures or components located on an opposite end of the stack of weights 130 as base 142 that are configured to assist in guiding movement of weights 130 along guide rods 128. Upper guide 127 includes top plate 148 and guide rod bushings 149. Top plate 148 serves as a cap for the stack of weights 130. Top plate 148 supports remaining components of upper guide 127. In the particular example illustrated, top plate 148 further supports incremental weight selection system 138.

Guide rods 128 comprise elongate structures extending from base 142 through weights 130 to top support 146. In the example illustrated, guide rods 128 additionally extend through risers and bumpers 149. Guide rods 128 are configured to orient weights 130 and guide movement of weights 130 as they are being lifted or lowered. In particular embodiments, guide rods 128 may have other configurations or may be omitted.

Weights 130 comprise structures having predetermined weight amounts which are configured to be lifted and to provide a mechanical resistance in an exercise. In the particular example illustrated, weights 130 each comprise a solid or hollow plate of one or more metals. In other embodiments, weights 130 may comprise other materials or may comprise encapsulated materials, such as sand, water or other materials. Weights 130 are stacked upon one another such that as a particular weight 130 is being lifted, other weights 130 stacked upon the particular weight 130 are also lifted.

Incremental weight 136 comprises a member having a predetermined weight amount that is configured to be selectively connected to weight lift 135 by incremental weight selection system 138. In one embodiment, incremental weight 136 has a weight amount less than a predetermined weight amount of each of main weights 130. For example, in one embodiment, each of main weights 130 may be 10 pounds while incremental weight 136 is 5 pounds. In one embodiment, incremental weight 136 may comprise 2.5 pound incremental weight. Incremental weight 136 permits a person to select a total amount of weight for an exercise that is intermediate or between the larger weight increments provided by main weights 130.

Incremental weight guide and support 137 comprises rod 160, riser 162 and bumper 164. Rod 160 extends from base 142 to top support 146 of frame 126. Rod 160 extends through incremental weight 136 and guides vertical sliding movement of incremental weight 136 when incremental weight 136 is connected to weight stack 132 by incremental weight selection system 138. Riser 162 comprises a member positioned about rod 160 to elevate and support bumper 164 and incremental weight 136.

Bumper 164 comprises a resiliently compressible member positioned between riser 144 and incremental weight 136. Bumper 164 is configured to absorb the impact of weight 136 as weight 136 is dropped or otherwise lowered. In the example embodiment illustrated, bumper 164 are each formed from a bulk or mass of rubber. In other embodiments, bumper 164 may be formed from other resiliently compressible materials or may include other resiliently compressible members, such as one or more springs. In still other embodiments, bumper 164 or riser 162 may be omitted.

As shown by FIG. 1, incremental weight 136 longitudinally extends across multiple weights 130. In the example implementation, incremental weight 136 extends along a rear face of main weights 130, being at least partially received within aligned notches or cut outs 200 of main weights 130. In some implemenations, cut outs 200 may be omitted. Incremental weight 136 includes a hook recipient 140 to be hooked by incremental weight selection system 138. In the example illustrated, hook recipient 140 comprises a lip, overhang or catch. In other implementations, hook recipient 140 may comprise a detent, notch or aperture for receiving a hook or catch.

Figure 3:
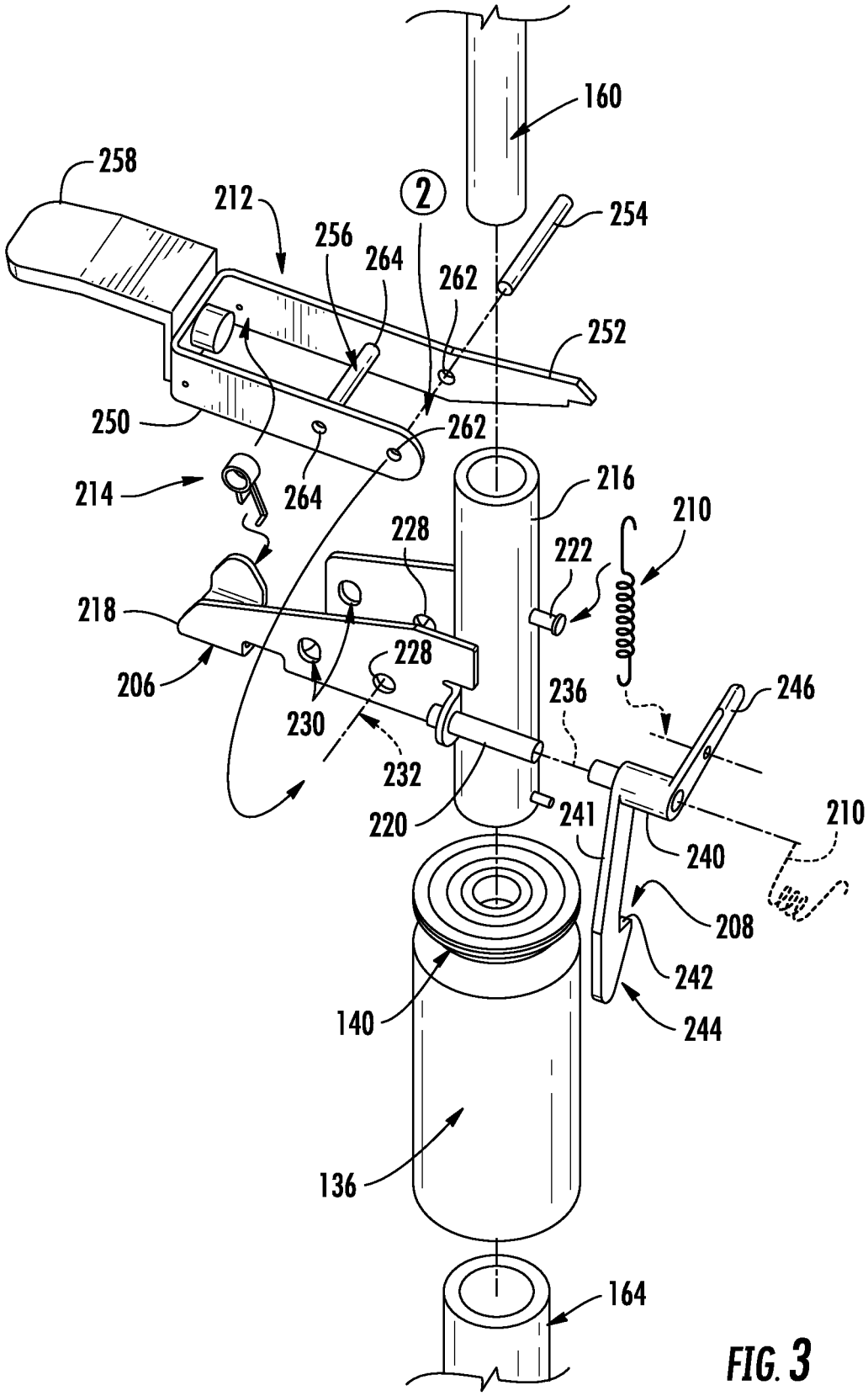
FIG. 3 is an exploded perspective view of an example incremental weight and incremental weight selection system of the weight system of FIG. 2.

Incremental weight selection system 138 comprises a mechanism configured to selectively add or remove incremental weight 136 from the total amount of weight connected to weight lift 35. FIG. 3 is an exploded perspective view illustrating incremental weight selection system 138 in more detail. As shown by FIG. 3, incremental weight selection system 138 comprises a carriage 206, hook 208, bias 210, actuation lever 212 and bias 214.

Carriage 206 comprises one or more structures or members coupled to top plate 272 be carried by top plate 127 and to be raised and lowered by weight lift 35 and cable system 24 (shown in FIG. 1). In the example illustrated, vertical movement of carriage 206 is further guided by rod 160. Carriage 206 movably supports hook 208 and actuation lever 212. Carriage 206 comprises guide 216, bracket 218 and pivot guide 220. Guide 216 comprises a tube extending about rod 160 that is slidable relative to and along rod 160. Guide 216 slidably supports movement of bracket 218. Guide 216 provides an additional bearing which interacts with an additional guide rod 160 such that minimal additional friction from the offset load of incremental weight selection system 138 results when no weight below top plate 148 is selected but for incremental weight 136. In one implementation, guide 216 further includes a catch 222 for engagement with bias 210. In other implementations, catch 222 may be associated with bracket 218 or may be omitted. In other implementations, guide 216 may alternatively comprise a member that partially wraps about rod 160.

Bracket 218 comprises one or more structures extending from and coupled to guide 216 so as to move with guide 216 along rod 160. Bracket 218 pivotally supports actuation lever 212 while providing an over-center toggle through the use of bias 214. In the example illustrated, bracket 212 comprises a first pair of openings 228 and a second pair of openings 230. Openings 228 are aligned with one another on opposite sides of bracket 218 and define a pivot axis 232 for pivotal movement of bracket 212. Openings 230 comprise elongated openings aligned with one another on opposite sides of bracket 218. Openings 230 receive a projection or pin extending from actuation lever 212 to guide and limit pivotal movement of lever 212 about axis 232.

Pivot guide 220 comprises an axle, pin or tube supported by an extending from bracket 218. Pivot guide 220 extends through hook 208 to define a rotational or pivot axis 236 for pivotal movement of hook 208. In other implementations, pivot guide 220 may comprise a sleeve receiving an axle of hook 208 to guide pivotal movement or rotation of hook 208.

Figure 4:
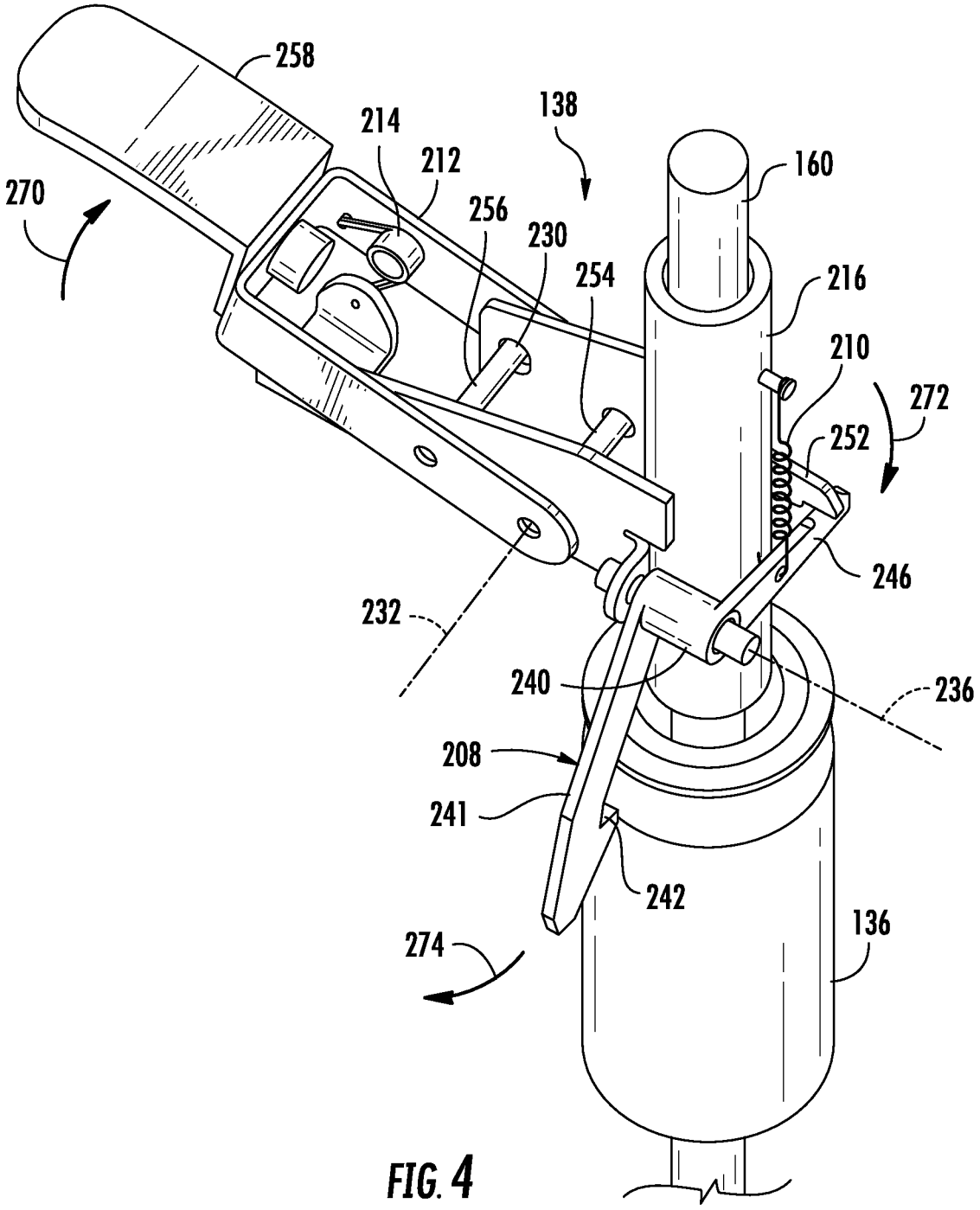
FIG. 4 is a fragmentary perspective view of the incremental weight and incremental weight selection system of FIG. 3 illustrating the incremental weight selection system disengaged from the incremental weight.
Figure 5:
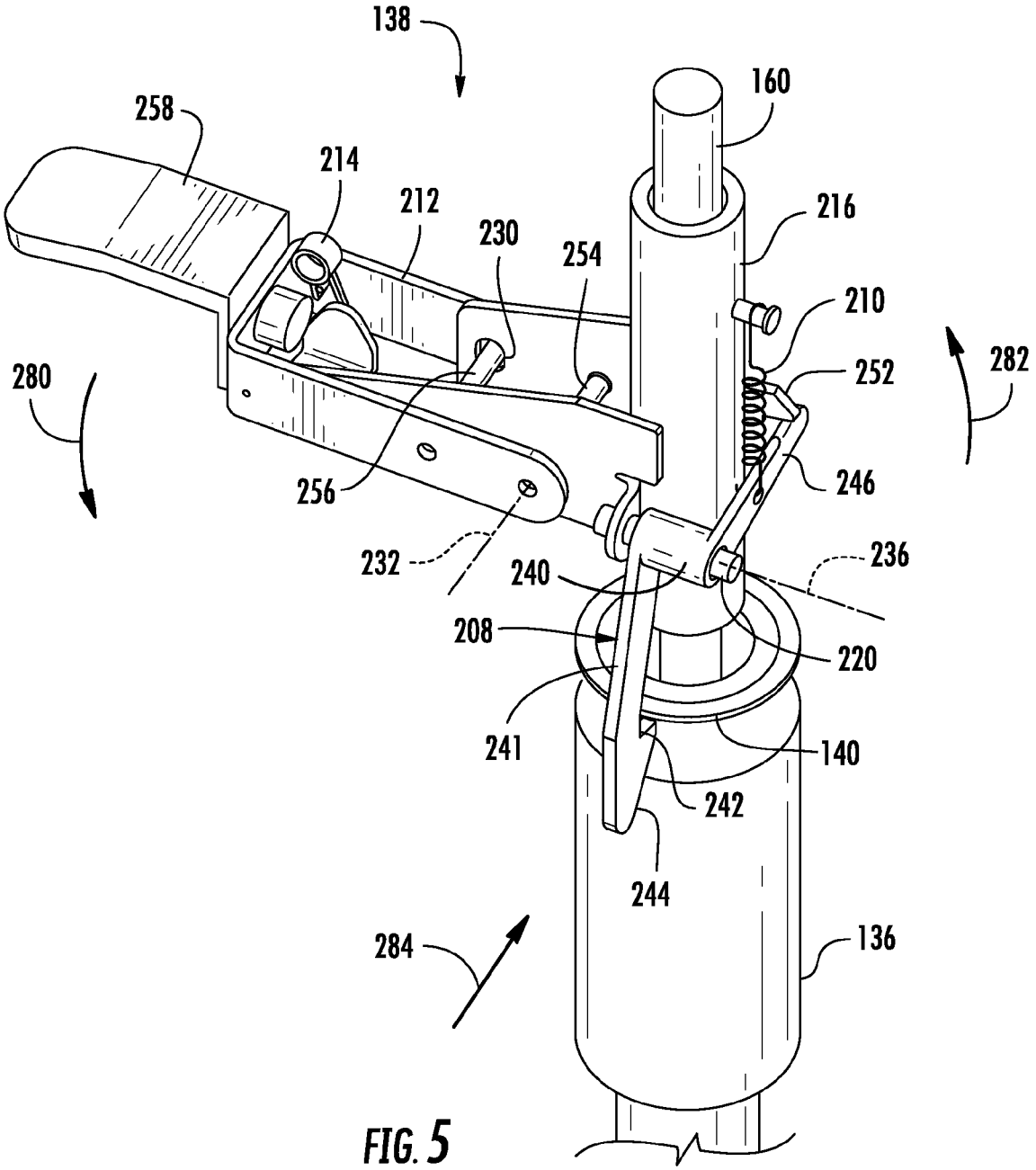
FIG. 5 is a fragmentary perspective view of the incremental weight and incremental weight selection system of FIG. 3 illustrating the incremental weight selection system engaged with the incremental weight.

Hook 208 comprises a member movable between an incremental weight disengaged position (shown in FIG. 4) and an engaged position (shown in FIG. 5). Hook pivots about horizontal axis 236 between the disengaged and engaged positions. In the engaged position, hook 208 catches upon hook receiver 140 such that incremental weight 136 is additionally lifted with whatever main weights 130 are being lifted. In the disengaged position, hook 208 is released from hook receiver 140 such that whatever main weights 130 are being lifted are lifted independent of and without lifting of incremental weight 136.

Hook 208 comprises hub 240, arm 241, catch 242, edge 244 and lever arm 246. Hub 240 comprises a tubular member encircling the shaft or pin of guide 220 for rotational movement about guide 220. As noted above, in other implementations, hub 240 may itself comprise a pivot shaft received within a tube or sleeve of guide 220.

Arm 241 extends from hub 240 and supports catch 242 and edge 244. Catch 242 comprises a shoulder supported at a spaced location from hub 240 for catching upon or engaging an underside of hook receiver 140. Edge 244 extends from catch 242 and comprises a beveled, curved or tapered edge or surface. Edge 244 contacts incremental weight 136 above hook receiver 140 to rotate hook 208 against bias 210 as catch 242 is being lowered past the lip of hook receiver 140. Once edge 244 has passed the overhang of hook receiver 140, bias 210 automatically moves catch 242 into engagement with hook receiver 140. As a result, hook 208 will automatically move to the engaged or hooking position even though incremental weight selection system 138 has been actuated while the weights are being lifted.

Lever arm 246 extends from hub 240 and is angularly offset from arm 241 about axis 236. Lever arm 246 is configured to be worked upon by lever 212 to move hook 208 against bias 210 from the engaged position to the disengaged position. In other implementations, lever arm 246 may alternatively be configured to be worked upon my lever 212 to move hook 208 from a disengaged position to an engaged position.

Bias 210 comprises a spring to resiliently bias hook 208 towards the engaged position. In the example illustrated, bias 210 comprises a tension spring having a first end connected to lever arm 246 of hook 208 and a second end connected to catch 222 of carriage 218. In other implementations, as shown by broken lines, bias 210 may alternatively comprise a torsion spring having one end connected to hook 208 and a second end connected to carriage 218. In other implementations, bias 210 may alternatively bias hook 208 towards a disengaged position.

Actuation lever 212 interacts with hook 208 to move hook 208 between the engaged and disengaged positions. Actuation lever 212 comprises bracket 250, toggle arm 252, pivot pin 254, pivot stop 256 and handle 258. Bracket 250 supports toggle arm 252, pivot pin 254, pivot stop 256 and handle 258. Bracket 250 comprises a pair of aligned openings 262 through which pivot pin 254 extends, and a pair of aligned openings 264 through which pivot stop 256 extends. Toggle arm 252 extends from bracket 250 for engagement with lever arm 246 of hook 208.

Pivot pin 254 extends into openings 262 and through openings 228 of bracket 218 to pivotally support lever arm 212 about axis 232. Pivot stop 256 comprises a pin or shaft extending through openings 264 and through openings 230 of bracket 218. Pivot stop 256 moves within openings/slots 230 and engages edges of openings 232 limit pivotal movement of lever 212. Handle 258 extends from an end portion of bracket 250 and is configured for being manually engaged for the application of force to actuation lever 212.

Bias 214 comprises a spring operably coupled between actuation lever 212 and bracket 218 to provide actuation lever 212 with over-center camming action. In particular, at midpoint of permissible pivotal movement (as defined by openings 230), bias 214 is stretched or otherwise moved away from a default more relaxed spring condition to the greatest extent. On either side of the midpoint, bias 214 is stretched or otherwise moved away from the default relaxed spring condition to a lesser extent. As a result, bias 214 resiliently retains lever 212 in either a raised state or a fully lowered state. In the example illustrated, bias 214 comprises a torsion spring having one end connected to bracket 250 and a second end connected to bracket 218.

FIGS. 4 and 5 illustrate operation of incremental weight selection system 138. FIG. 4 illustrates incremental weight selection system with hook 208 in a disengaged position. As shown by FIG. 4, actuation lever 212 is pivoted in an upward direction about axis 232 as indicated by arrow 270. Bias 214 resiliently retains lever 212 in the raised position with pivot stop 256 engaging an upper edge or surface of openings 230. As a result, toggle lever 252 is moved downward in the direction indicated by arrow 272 to depress lever arm 246 against the bias 210 and so as to rotate arm 241 and catch 242 in a direction indicated by arrow 274 about axis 236 to the illustrated disengaged position.

As shown by FIG. 5, actuation lever 212 is pivoted in a downward direction about axis 232 as indicated by arrow 280. Bias 214 resiliently retains lever 212 in the lowered position with pivot stop 256 engaging a lower edge of openings 230. As a result, toggle lever 252 is moved upward in the direction indicated by arrow 282, allowing bias 210 to rotate arm 241 and catch 242 in a direction indicated by arrow 284 about axis 236 to the illustrated engaged position.

Figure 7:
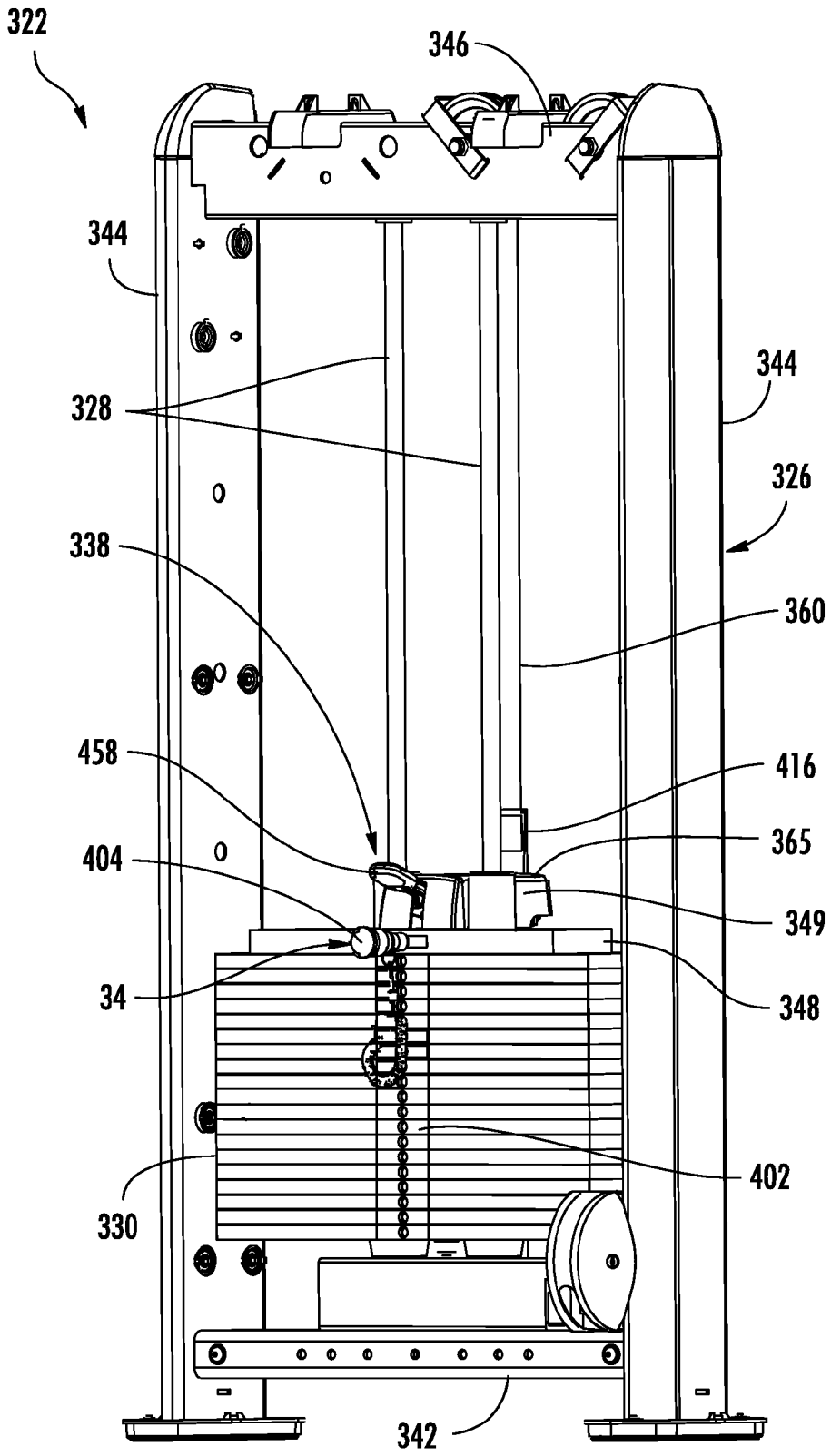
FIG. 7 is a front perspective view of the weight system of FIG. 6.
Figure 8:
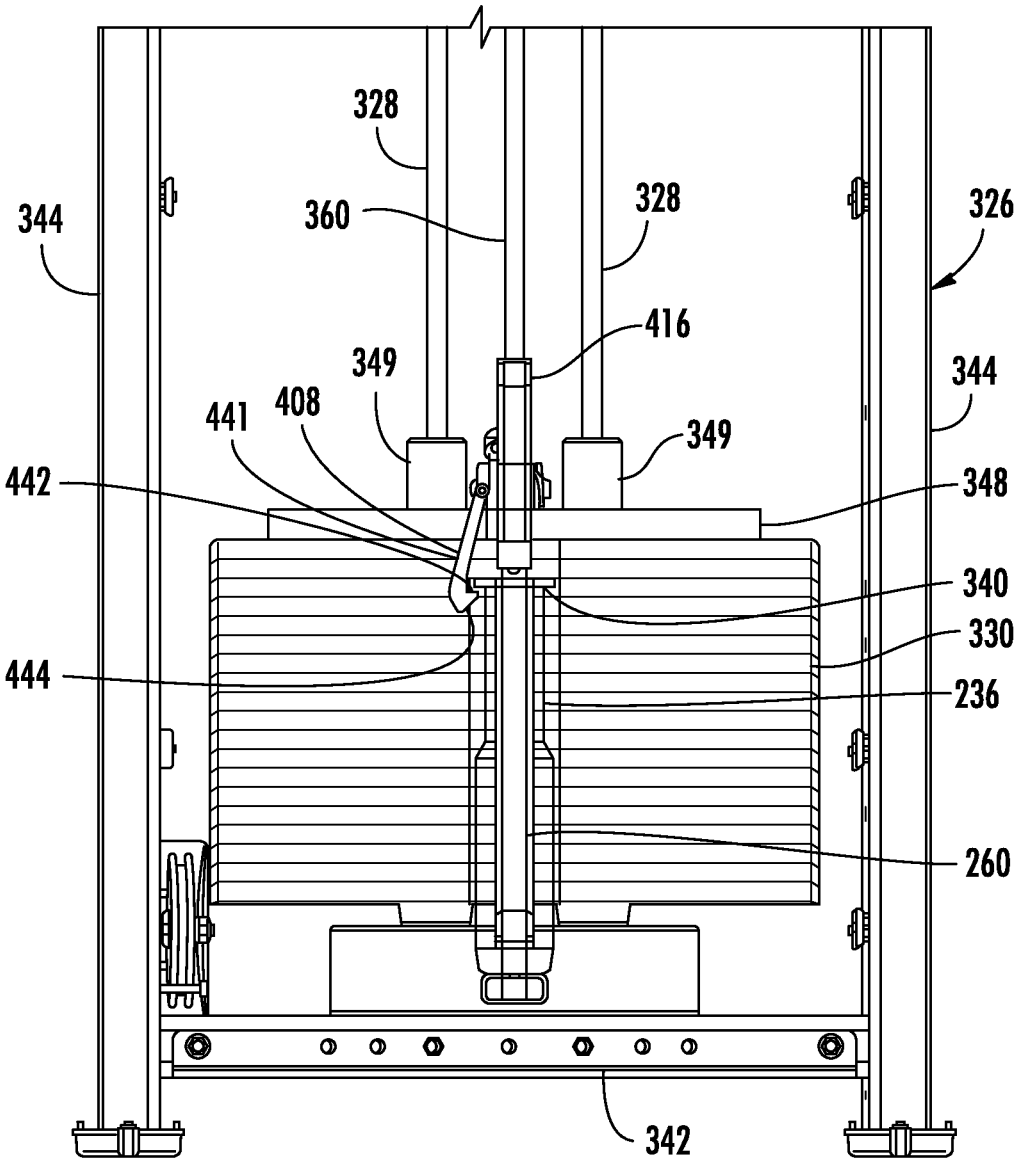
FIG. 8 is a fragmentary sectional view of the weight system of FIG. 6.
Figure 9:
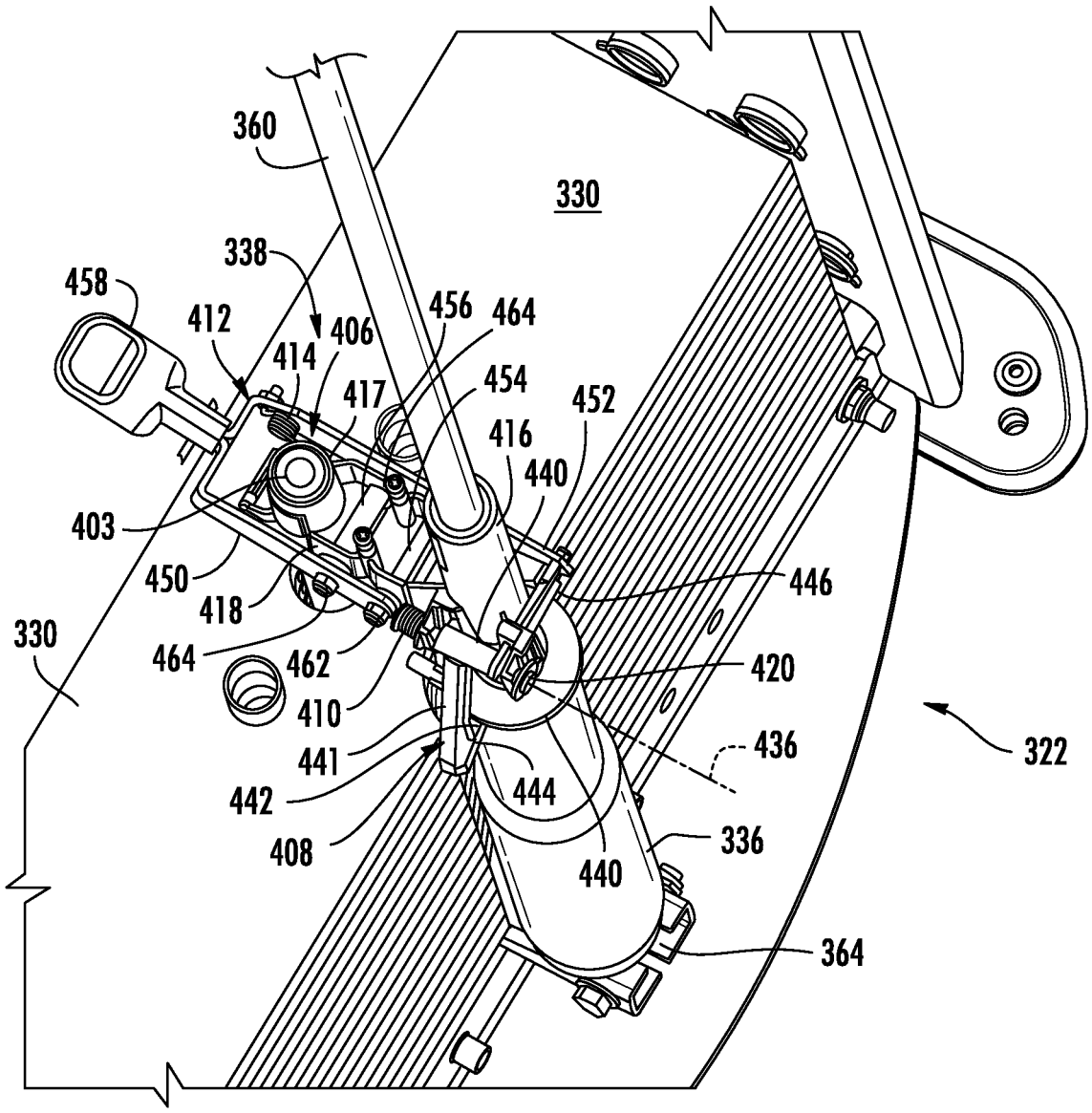
FIG. 9 is a fragmentary top perspective view of the weight system of FIG. 6 with portions omitted for purposes of illustration.
Figure 10:
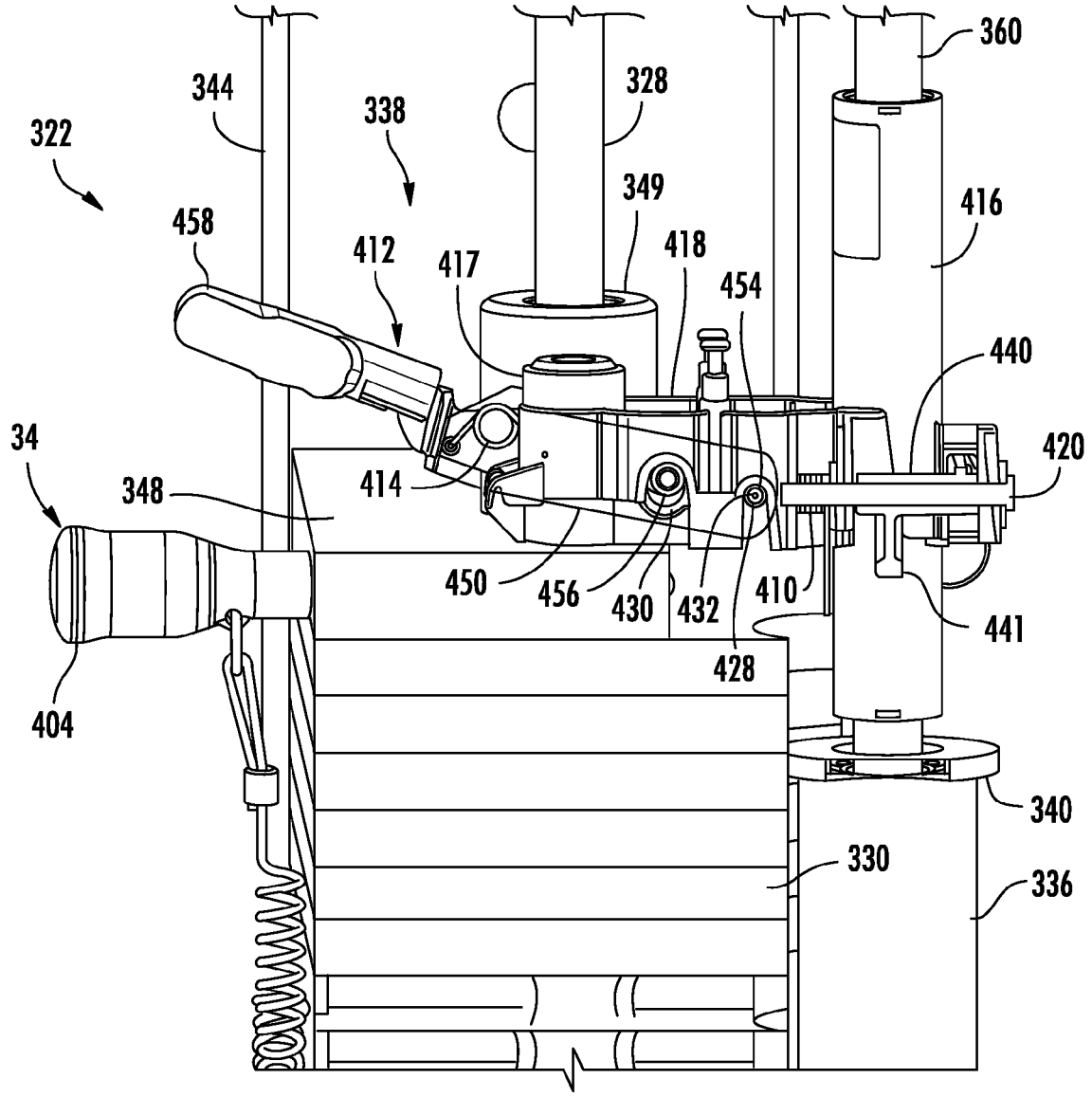
FIG. 10 is a fragmentary sectional view of the weight system of FIG. 6 with ports and transparently shown and omitted for purposes of illustration.

FIGS. 6-10 illustrate weight system 322, an example implementation of weight system 22 which may be employed as part of exercise device 20 shown in FIG. 1. FIGS. 9 and 10 illustrate weight system 322 with portions omitted or transparently shown. In particular, FIG. 9 omits shroud 365 shown in FIG. 7. FIG. 10 is a sectional view, wherein shroud 365 is omitted and wherein portions of bracket 418 are transparently illustrated.

Weight system 322 is similar to weight system 122. Weight system 322 comprises frame 326, upper guides 327, guide rods 328, weights 330 forming a main weight stack 332, main weight selection system 34 (described above), weight lift 35, incremental weight 336, incremental weight guide and support 337 and incremental weight selection system 338. Frame 326 comprises an arrangement of components configured to serve as a foundation and support for weight system 322. Frame 326 includes base 342, side beams 344, and the top support 346.

Upper guide 327 comprises an arrangement of structures or components located on an opposite end of the stack of weights 330 as base 342 that are configured to assist in guiding movement of weights 330 along guide rods 328. Upper guide 327 includes top plate 348 and guide rod bushings 349. Top plate 348 serves as a cap for the stack of weights 330. Top plate 348 supports remaining components of upper guide 327. In the particular example illustrated, top plate 348 further supports incremental weight selection system 338.

Guide rods 328 comprise elongate structures extending from base 342 through weights 330 to top support 346. In the example illustrated, guide rods 328 additionally extend through risers and bumpers 349. Guide rods 328 are configured to orient weights 330 and guide movement of weights 330 as they are being lifted or lowered. In particular embodiments, guide rods 328 may have other configurations or may be omitted.

Weights 330 comprise structures having predetermined weight amounts which are configured to be lifted and to provide a mechanical resistance in an exercise. In the particular example illustrated, weights 330 each comprise a solid or hollow plate of one or more metals. In other embodiments, weights 330 may comprise other materials or may comprise encapsulated materials, such as sand, water or other materials. Weights 330 are stacked upon one another such that as a particular weight 330 is being lifted, other weights 330 stacked upon the particular weight 330 are also lifted.

As shown by FIG. 7, main weight selection system 34 comprises an aperture 402 in each of weights 330 which is configured to align with a corresponding aperture in a weight lift rod 403 (shown in FIG. 9) (also known as a weight selection stem) when weights 330 are not being lifted and are resting upon base 342. Main weight selection system 34 further comprises a weight selection pin 404 to be inserted within such aligned openings, securing a selected one of weights 330 to weight lift rod 403 which is lifted by weight lift 35 and cable system 34 (shown in FIG. 1).

Incremental weight 336 comprises a member having a predetermined weight amount that is configured to be selectively connected to weight lift 335 by incremental weight selection system 338. In one embodiment, incremental weight 336 has a weight amount less than a predetermined weight amount of each of main weights 330. For example, in one embodiment, each of main weights 330 may be 10 pounds while incremental weight 336 is 5 pounds. In one embodiment, incremental weight 336 may comprise 2.5 pound incremental weight. Incremental weight 336 permits a person to select a total amount of weight for an exercise that is intermediate or between the larger weight increments provided by main weights 330.

Incremental weight guide and support 337 comprises rod 360, and riser/bumper 364. Rod 260 extends from base 342 to top support 346 of frame 326. Rod 360 extends through incremental weight 336 and guides vertical sliding movement of incremental weight 336 when incremental weight 336 is connected to weight stack 332 by incremental weight selection system 338.

Bumper 364 comprises a resiliently compressible member positioned below incremental weight 336 about rod 360. Bumper 364 is configured to absorb the impact of weight 336 as weight 336 is dropped or otherwise lowered. In the example embodiment illustrated, bumper 364 are each formed from a bulk or mass of rubber. In other embodiments, bumper 364 may be formed from other resiliently compressible materials or may include other resiliently compressible members, such as one or more springs. In still other embodiments, bumper 364 may be omitted.

Figure 6:
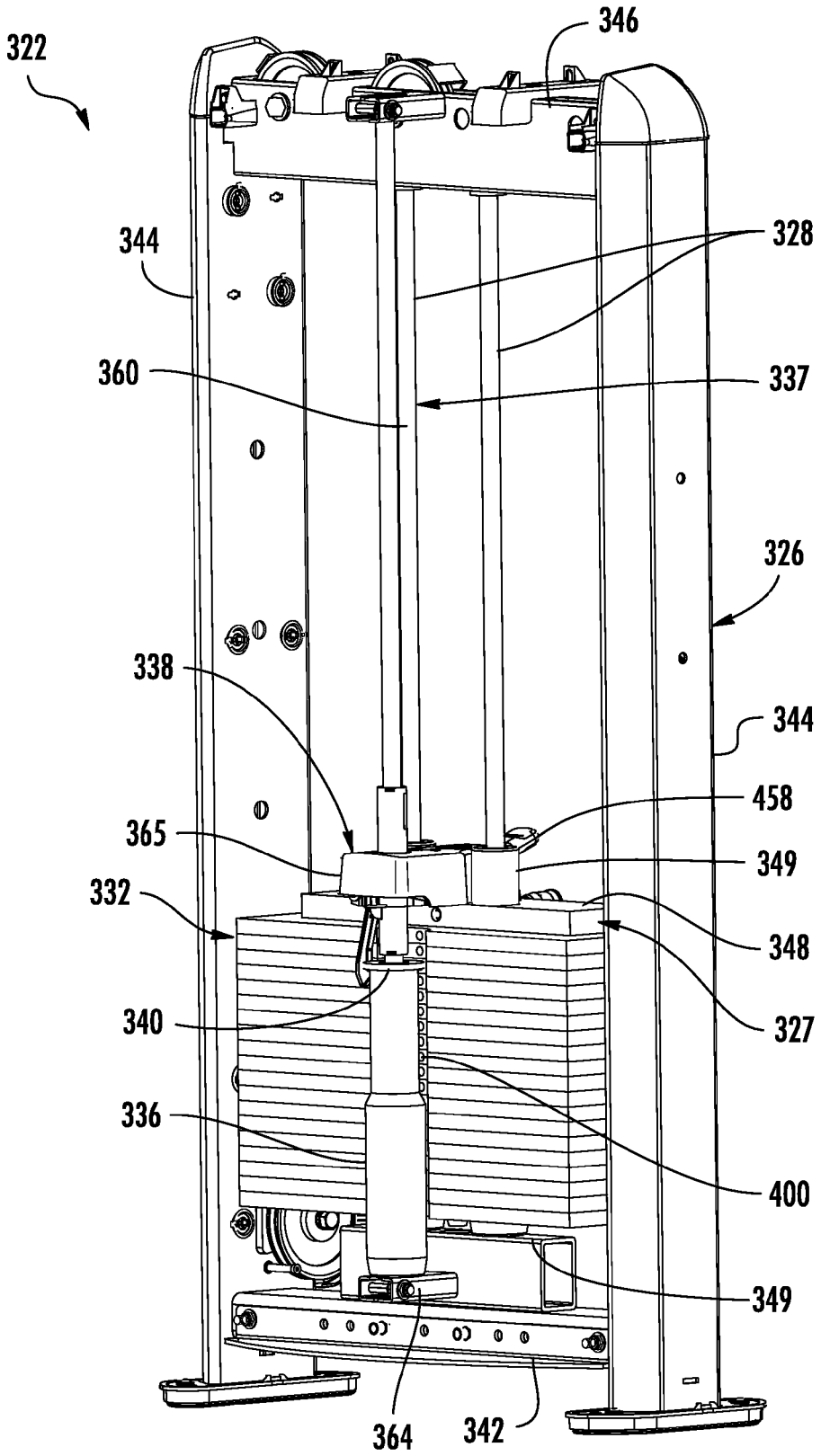
FIG. 6 is a rear perspective view of another example weight system of the exercise device of FIG. 1.

As shown by FIGS. 6 and 8, incremental weight 336 longitudinally extends across multiple weights 330 about rod 360 for sliding movement along rod 360. In the example implementation, incremental weight 336 extends along a rear face of main weights 330, being at least partially received within aligned notches or cut outs 400 of main weights 330. In some implementations, such cut outs 400 may be omitted. Incremental weight 236 includes a hook recipient 340 to be hooked by incremental weight selection system 338. In the example illustrated, hook recipient 340 comprises a ring having a lip, overhang or catch. In other implementations, hook recipient 340 may comprise a detent, notch or aperture for receiving a hook or catch.

Incremental weight selection system 338 comprises a mechanism configured to selectively add or remove incremental weight 336 from the total amount of weight connected to weight lift 35. FIGS. 9 and 10 illustrate incremental weight selection system 338 in more detail with portions (such as shroud 365 shown in FIG. 7) omitted or transparently shown for purposes of illustration. As shown by FIG. 9, incremental weight selection system 338 comprises carriage 406, hook 408, bias 410, actuation lever 412 and bias 414.

Carriage 406 comprises one or more structures or members coupled to top plate 348 to be carried by top plate 348 and to be raised and lowered by weight lift 35 and cable system 24 (shown in FIG. 1). In the example illustrated, vertical movement of carriage 406 is further guided by rod 360. Carriage 406 movably supports hook 408 and actuation lever 412. Carriage 406 comprises guide 416, mount 417, bracket 418 and pivot shaft 420. Guide 416 comprises a tube extending about rod 360 that is slidable relative to and along rod 360. Guide 416 slidably supports movement of bracket 418. Guide 416 provides an additional bearing which interacts with an additional guide rod 360 such that minimal additional friction from the offset load of incremental weight selection system 338 results when no weight below top plate 148 is selected but for incremental weight 336. In other implementations, guide 416 may alternatively comprise a member that partially wraps about rod 360.

Mount 417 comprises a tube fixed to carriage 406 and fixed to weight lift rod 403 to position and hold the carriage on rod 403.

Bracket 418 comprises one or more structures extending from and coupled to guides 416 and 417 so as to move with guide 416 and mount 417 along rod 460. Bracket 418 pivotally supports actuation lever 412 while providing an over-center toggle through the use of bias 414. In the example illustrated, bracket 412 comprises a first pair of openings 428 and a second pair of openings 430. Openings 428 are aligned with one another on opposite sides of bracket 418 and define a pivot axis 432 for pivotal movement of bracket 412. Openings 430 comprise elongated openings aligned with one another on opposite sides of bracket 418. Openings 430 receive a projection or pin extending from actuation lever 412 to guide and limit pivotal movement of lever 412 about axis 432 and within openings 430.

Pivot guide 420 comprises an axle, pin or tube supported by an extending from bracket 418. Pivot guide 420 extends through hook 408 to define a rotational or pivot axis 436 for pivotal movement of hook 408. In other implementations, pivot guide 400 may comprise a sleeve receiving an axle of hook 408 to guide pivotal movement of hook 408.

Hook 408 comprises a member movable between an incremental weight disengaged position (shown in FIG. 4) and an engaged position (shown in FIG. 5). Hook pivots about horizontal axis 436 between the disengaged engage positions. In the engaged position, hook 408 catches upon hook receiver 340 such that incremental weight 336 is additionally lifted with whatever main weights 330 are being lifted. In the disengaged position, hook 408 is released from hook receiver 340 such that whatever main weights 330 are being lifted are lifted independent of and without lifting of incremental weight 336.

Hook 408 comprises hub 440, arm 441, catch 442, edge 444 and lever arm 446. Hub 440 comprises a tubular member encircling the shaft or pin of guide 420 for rotational movement about guide 420. As noted above, in other implementations, hub 440 may itself comprise a pivot shaft received within a tube or sleeve of guide 420.

Arm 441 extends from hub 440 and supports catch 442 and edge 444. Catch 442 comprises a shoulder supported at a spaced location from hub 440 for catching upon or engaging in underside of hook receiver 340. Edge 444 extends from catch 442 and comprises a beveled, curved or tapered edge or surface. Edge 444 contacts incremental weight 336 above hook receiver 340 to rotate hook 408 against bias 410 as catch 442 is being lowered past the lip of hook receiver 340. Once edge 444 has passed the overhang of hook receiver 340, bias 410 automatically moves catch 442 into engagement with hook receiver 340. As a result, hook 408 will automatically move to the engaged or hooking position even though incremental weight selection system 338 has been actuated while the weights are being lifted.

Lever arm 446 extends from hub 440 and is angularly offset from arm 441 about axis 436. Lever arm 446 is configured to be worked upon by lever 412 to move hook 408 against bias 410 from the engaged position to the disengaged position. In other implementations, lever arm 446 may alternatively be configured to be worked upon my lever 412 to move hook 408 from a disengaged position to an engaged position.

Bias 410 comprises a spring to resiliently bias hook 408 towards the engaged position. In the example illustrated, bias 410 comprises a torsion spring having one end connected to hook 408 and a second end connected to carriage 418. In other implementations, bias 410 may alternatively bias hook 408 towards a disengaged position.

Actuation lever 412 interacts with hook 408 to move hook 408 between the engaged and disengaged positions. Actuation lever 412 comprises bracket 450, toggle arm 452, pivot pin 454, pivot stop 456 and handle 458. Bracket 450 supports toggle arm 452, pivot pin 454, pivot stop 456 and handle 458. Bracket 450 comprises a pair of aligned openings 462 through which pivot pin 454 extends, and a pair of aligned openings 177 through which pivot stop 456 extends. Toggle arm 452 extends from bracket 450 for engagement with lever arm 446 of hook 408.

Pivot pin 454 extends through openings 462 and through openings 428 (shown in FIG. 10) of bracket 418 to pivotally support lever arm 412 about axis 432. Pivot stop 456 comprises a pin or shaft extending through openings 464 and through openings 430 (shown in FIG. 10) of bracket 418. Pivot stop 456 moves within openings/slots 430 and engages edges of openings 430 to limit pivotal movement of lever 412. Handle 458 extends from an end portion of bracket 418 and is configured for being manually engaged for the application of force to actuation lever 412.

Bias 414 comprises a spring operably coupled between actuation lever 412 and bracket 418 to provide actuation lever 412 with over-center camming action. In particular, at midpoint of permissible pivotal movement (as defined by openings 430), bias 414 is stretched to the greatest extent. On either side of the midpoint, bias 414 is stretched to a lesser extent. As a result, bias 414 resiliently retains lever 412 in either a fully raised state or a fully lowered state. In the example illustrated, bias 414 comprises a torsion spring having one end connected to bracket 450 of lever 412 and a second end connected to bracket 418.

Incremental weight selection system 338 operates in a fashion similar to incremental weight selection system 138. When incremental weight 336 is not to be added to the main weights 330 to be lifted, actuation lever 412 is pivoted in an upward direction about axis 432. Bias 414 resiliently retains lever 412 in the raised position with pivot stop 456 engaging and upper edge or surface of openings 430. As a result, toggle lever 452 is moved downward to depress lever arm 446 against the bias 410 and so as to rotate arm 441 and catch 442 about axis 436 to a disengaged position similar to that shown in FIG. 4 with respect to system 138.

When incremental weight 336 is to be added to main weights 330 to be lifted, actuation lever 412 is pivoted in a downward direction about axis 432. Bias 414 resiliently retains lever 412 in the lowered position with pivot stop 456 engaging a lower edge of openings 430. As a result, toggle lever 452 is moved upward, allowing bias 410 to rotate arm 441 and catch 442 about axis 436 to the engaged position.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise apparatus comprising:

an incremental weight system comprising:

an incremental weight; and an incremental weight selector configured to be carried by a first weight of a stack of weights that is liftable by a weight lift, the selector having a lever comprising a manually engageable handle that is pivotable about a first horizontal axis between a lowered position and a raised position to pivot a lifting hook about a second horizontal axis between an engaged position in which the lifting hook directly engages, contacts and hooks against the incremental weight such that the incremental weight is liftable with the first weight by the weight lift and a disengaged position in which the lifting hook is out of contact with and is disengaged from the incremental weight such that the first weight is liftable independent of the incremental weight.

2. The apparatus of claim 1, wherein the lifting hook is resiliently biased to the engaged position.

3. The apparatus of claim 2, wherein the incremental weight comprises a hook receiver having an overhang and wherein the hook comprises:

a catch to contact and catch upon an underside of the overhang of the incremental weight; and a beveled edge leading to the catch, the beveled edge configured to bear against the overhang as the catch is lowered past the overhang.

4. The apparatus of claim 1 further comprising an incremental weight guide rod extending through the incremental weight and along which the incremental weight is movable as the incremental weight is raised and lowered.

5. The apparatus of claim 4, wherein the lifting hook comprises an incremental weight engagement surface, wherein the incremental weight includes a catch surface for being engaged by the engagement surface and wherein the apparatus further comprises a riser supporting the catch surface opposite to and in alignment with the engagement surface.

6. The apparatus of claim 1, wherein the lifting hook is pivotable about the second horizontal axis between a locked position and an unlocked position, the lifting hook being resiliently biased towards the locked position.

7. The apparatus of claim 6, wherein the lever is an over-center toggle lever.

8. The apparatus of claim 1 further comprising:

the stack of weights including the first weight; and the weight lift.

9. The apparatus of claim 8 further comprising:

a set of stack guide rods guiding vertical movement of the stack of weights; and an incremental weight guide rod extending through the incremental weight, wherein the incremental weight guide rod guides vertical movement of the incremental weight is guided independent of the set of stack guide rods.

10. The apparatus of claim 1, wherein the manually engageable handle is in the lowered position when the lifting hook is in the engaged position.

11. The apparatus of claim 1 further comprising an over-center spring resiliently biasing the lever to one of the raised position and the lowered position, wherein movement of the lever towards a midpoint of a range of permissible pivotal movement for the lever stretches the over-center spring to a greater extent, away from a relaxed spring condition.

12. The apparatus of claim 1, wherein the lever is an over-center toggle lever.

13. The apparatus of claim 1, wherein the incremental weight is configured to extend below the first weight when the selector is mounted to the incremental weight.

14. The apparatus of claim 1, wherein the first axis extends perpendicular to the second axis.

15. The apparatus of claim 1, wherein the first weight has a minor horizontal dimension and a major horizontal dimension greater than the minor horizontal dimension, wherein the first axis extends parallel to the major horizontal dimension and wherein manually engageable handle is depressable about the first axis from the raised position to the lowered position.

16. An exercise apparatus comprising:

a stack of weights including a first weight;

a weight lift;

an incremental weight; and an incremental weight selector mounted to the first weight so as to be carried by the first weight, the selector having an over-center toggle lever movable to actuate the selector between an engaged position engaging the incremental weight such that the incremental weight is liftable with the first weight by the weight lift and a disengaged position disengaged from the incremental weight such that the first weight is liftable independent of the incremental weight; and an over-center spring resiliently biasing the lever, wherein movement of the lever towards a midpoint of a range of permissible pivotal movement for the lever stretches the over-center spring to a greater extent, away from a relaxed spring condition.

17. The exercise apparatus of claim 16, wherein the lever pivots about a horizontal axis between a raised position in which the selector is in the disengaged position and a lowered position in which the selector is in the engaged position.

18. An exercise apparatus comprising:

a stack of weights including a first weight;

a weight lift;

an incremental weight; and an incremental weight selector mounted to the first weight so as to be carried by the first weight, the selector having an over-center toggle lever movable to actuate the selector between an engaged position engaging the incremental weight such that the incremental weight is liftable with the first weight by the weight lift and a disengaged position disengaged from the incremental weight is liftable independent of the incremental weight, wherein incremental weight extends below the first weight and along a side of the stack of weights when the selector is connected to the incremental weight such that the incremental weight is movable with the first weight.

19. A method comprising:

pivoting a lever about a horizontal axis from a raised position to a lowered position;

pivoting a hook from a disengaged position to an engaged position in which the hook engages an incremental weight in response to movement of the lever from the raised position to the lowered position; and resiliently biasing the lever with an over-center action of a spring.

* * * * *